US007258083B2

(12) United States Patent
Lindsey

(10) Patent No.: US 7,258,083 B2
(45) Date of Patent: Aug. 21, 2007

(54) INTEGRATED COOLING SYSTEM

(75) Inventor: Robert Wayne Lindsey, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 11/214,901

(22) Filed: Aug. 31, 2005

(65) Prior Publication Data

US 2007/0044737 A1 Mar. 1, 2007

(51) Int. Cl.
*F01P 7/14* (2006.01)
*F01P 3/00* (2006.01)
*F01P 5/10* (2006.01)

(52) U.S. Cl. ..... 123/41.08; 123/41.29; 123/41.44

(58) Field of Classification Search ..... 123/41.44, 123/41.08, 198 C, 41.1, 41.29, 41.28; 417/410.1, 417/423.15, 321, 352, 360
See application file for complete search history.

(56) References Cited

U.S. PATENT DOCUMENTS

| | | | | |
|---|---|---|---|---|
| 4,194,178 | A | 3/1980 | Dumbeck | |
| 4,520,674 | A | 6/1985 | Canada et al. | |
| 5,019,760 | A | 5/1991 | Chu et al. | |
| 5,520,517 | A | 5/1996 | Sipin | |
| 5,726,911 | A | 3/1998 | Canada et al. | |
| 5,917,428 | A | 6/1999 | Discenzo et al. | |
| 6,077,051 | A | 6/2000 | Centers et al. | |
| 6,144,924 | A | 11/2000 | Dowling et al. | |
| 6,199,528 | B1 * | 3/2001 | Hotta et al. | 123/142.5 E |
| 6,262,550 | B1 | 7/2001 | Kliman et al. | |
| 6,474,951 | B2 * | 11/2002 | Stephan et al. | 417/26 |
| 6,529,135 | B1 | 3/2003 | Bowers et al. | |
| 6,612,815 | B2 * | 9/2003 | Pawellek et al. | 417/366 |
| 6,702,555 | B2 | 3/2004 | Allen et al. | |
| 6,705,254 | B1 * | 3/2004 | Grabowski et al. | 123/41.29 |
| 6,712,028 | B1 * | 3/2004 | Robbins et al. | 123/41.08 |
| 6,951,192 | B2 * | 10/2005 | Atschreiter et al. | 123/41.01 |
| 7,096,830 | B2 * | 8/2006 | Hollis et al. | 123/41.08 |
| 2004/0009075 | A1 | 1/2004 | Meza et al. | |
| 2005/0074337 | A1 | 4/2005 | Anderson et al. | |

FOREIGN PATENT DOCUMENTS

| | | |
|---|---|---|
| JP | 06149972 | 1/1996 |
| WO | WO 2004/059829 A1 | 7/2004 |

* cited by examiner

*Primary Examiner*—Stephen K. Cronin
*Assistant Examiner*—Hyder Ali
(74) *Attorney, Agent, or Firm*—Finnegan, Henderson, Farabow, Garrett & Dunner

(57) ABSTRACT

An integrated cooling system includes a housing and a pumping device disposed within the housing, configured to pressurize a fluid. The cooling system also includes a motor disposed within the housing and operatively coupled to the pumping device. The cooling system further includes a first cooling circuit configured to receive the pressurized fluid and circulate the pressurized fluid through at least one component external to the housing. The cooling system also includes a second cooling circuit in fluid communication with the first cooling circuit, and configured to direct at least a portion of the pressurized fluid through the motor.

35 Claims, 2 Drawing Sheets

INTEGRATED COOLING SYSTEM

TECHNICAL FIELD

This disclosure relates generally to cooling systems and methods, and, more particularly, to an integrated cooling system and method for a power system.

BACKGROUND

Power systems, such as, for example, internal combustion engines output a substantial amount of power and, in doing so, also generate a large amount of heat. If not properly controlled, this heat could damage the engine or result in inefficient operation of the engine. Fluid cooling systems are often used to transfer heat from the engine, thereby increasing the life and efficiency of the engine. A typical fluid cooling system includes a pump to circulate a cooling fluid through the engine, a motor drivingly coupled to the pump, and a controller to regulate operation of the motor. The cooling capacity of the cooling system ultimately depends on the motor. Inadequate heat dissipation from the motor may limit the amount of torque output of the motor, which may limit the amount of cooling fluid that the pump can circulate.

One method to dissipate heat from a motor associated with a cooling system is described in U.S. Pat. No. 6,702,555 (hereinafter referred to as "the '555 patent") issued to Allen et al. on Mar. 9, 2004. The '555 patent discloses a fluid pump with a diffuser, a stator disposed within a diffuser cavity, a tubular member isolating the diffuser from a working fluid flowing through the fluid pump, a rotor disposed within the tubular member for driving an impeller, and a controller disposed within the diffuser. The motor of the '555 patent drives a pump for circulating the working fluid through the pump. The circulation of fluid around the diffuser-contained motor and controller provides for improved heat transfer, and the integrated motor/pump configuration may reduce the number of interconnections required to operate separate pump and motor units.

Although the pump of the '555 patent may improve motor heat dissipation, it may still remove an insufficient amount of heat from the motor. For example, because the motor and controller are located within the diffuser and isolated from the working fluid, heat dissipation may be substantially hindered by the diffuser wall. Furthermore, the configuration of the system of the '555 patent may not provide adequate regulation of the flow rate of the pump. For example, the system of the '555 patent is not configured to monitor the temperature of the motor or the working fluid and adjust flow rate of the pump in accordance with the monitored temperature. As a result, because control of the flow rate of the pump is independent of motor temperature, additional heat generated by the motor may not be adequately extracted, which may result in inefficient and/or inadequate operation of the motor.

In addition, the system of the '555 patent may lack monitoring and control capabilities. For example, the controller of the '555 patent is not configured to monitor the operational characteristics (e.g., temperature, pressure, etc.) of either the motor or the working fluid and control the motor/pump in response to the monitored characteristics. Thus, should the motor or working fluid operational characteristics exceed a specified threshold, the '555 patent may not provide the necessary response to ensure appropriate operation of the cooling system. Furthermore, because flow rate is not controlled based on the cooling needs of the motor, the system of the '555 patent may still be prone to motor overheating.

The presently disclosed integrated cooling system and method are directed toward overcoming one or more of the problems set forth above.

SUMMARY OF THE INVENTION

In accordance with one aspect, the present disclosure is directed toward an integrated cooling system. The integrated cooling system may include a housing and a pumping device, disposed within the housing, configured to pressurize a fluid. The cooling system may also include a motor disposed within the housing and operatively coupled to the pumping device. The cooling system may further include a first cooling circuit configured to receive the pressurized fluid and circulate the pressurized fluid through at least one component external to the housing. The cooling system may also include a second cooling circuit in fluid communication with the first cooling circuit and configured to direct at least a portion of the pressurized fluid through the motor.

According to another aspect, the present disclosure is directed toward a method for operating a cooling system. The method may include operating a motor to pump a fluid through a fluid circuit. The method may also include monitoring at least one operational aspect of the motor. The method may further include directing at least a portion of the circulated fluid through the motor based on the at least one operational aspect.

DETAILED DESCRIPTION

Figure 1:
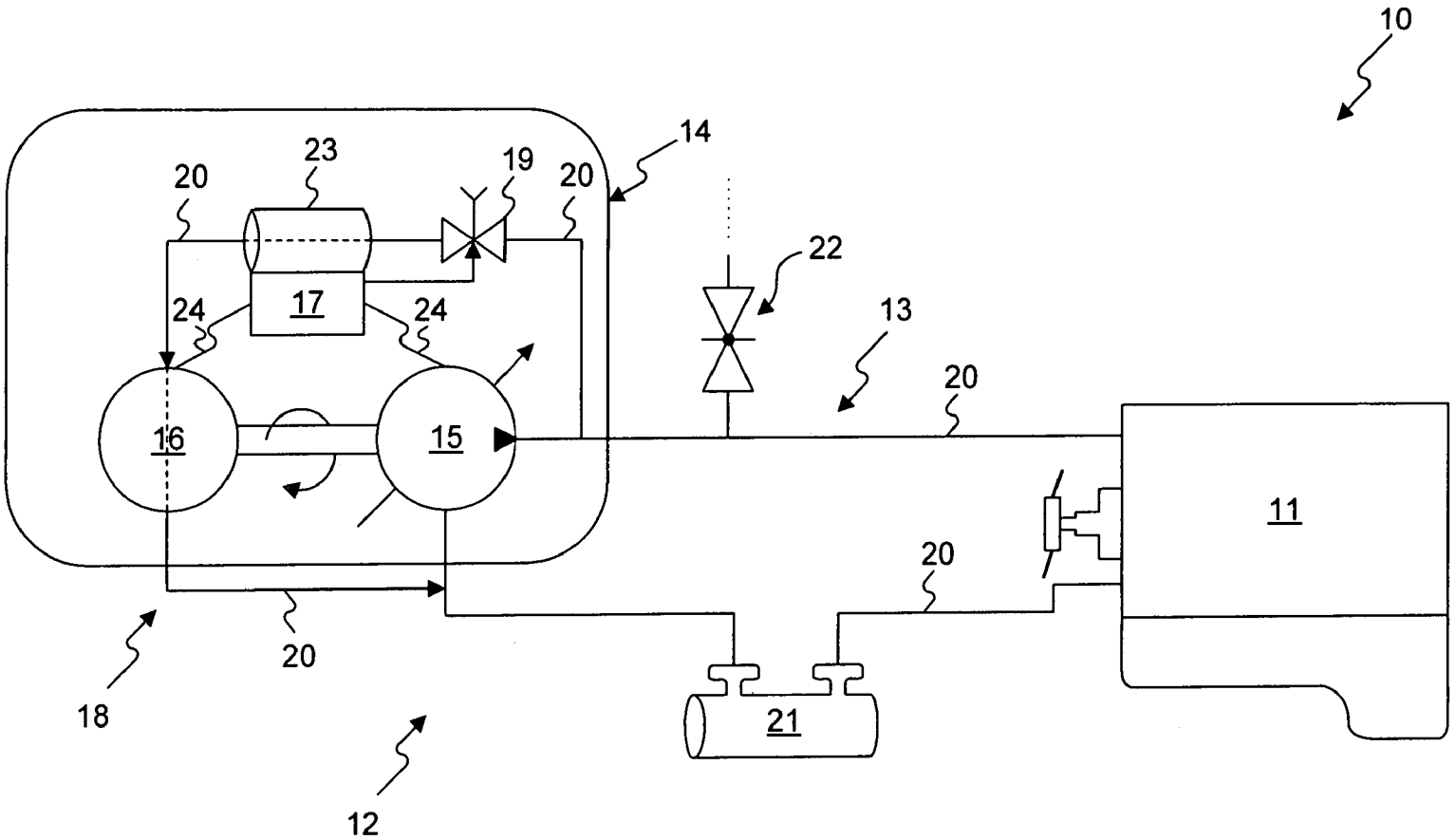
FIG. 1 is a diagrammatic illustration of an exemplary disclosed integrated cooling system.

FIG. 1 illustrates an exemplary disclosed power system 10 having a plurality of components that cooperate to perform a task associated with an industry such as mining, construction, manufacturing, agriculture, transportation, or any such industry. Power system 10 may include, among other things, a power source 11 to generate a power output and an integrated cooling system 12 coupled to power source 11 to dissipate heat generated by power system 10. Power system 10 may include a liquid-cooled engine, an air-cooled generator set, a silica gel-cooled fuel cell, an air-cooled turbine, or any other fluid-cooled power source.

Power source 11 may include one or more components configured to output energy for use by one or more components of power system 10. For example, power source 11 may include an internal combustion engine that operates on diesel fuel, gasoline, natural gas, or any type of fuel. Alternatively, power source 11 may include any type of device configured to output mechanical or electrical energy such as, for example, a fuel cell, a battery, a turbine, a generator, or any other appropriate device.

Integrated cooling system 12 may include one or more components for pressurizing, directing, and transporting a coolant through power source 11. For example, integrated cooling system 12 may include a first cooling circuit 13, a housing 14, a pumping device 15, a motor 16, a controller 17, and a second cooling circuit 18. While integrated cooling system 12 is described as a liquid-cooled system, it is contemplated that integrated cooling system 12 may include any other type of integrated cooling system such as, for example, a jetted air system (not shown), an oil system (not shown), a gel-based system (not shown), a pressurized gas system (not shown), or any other type of fluid integrated cooling system.

First cooling circuit 13 may include one or more components configured to receive a pressurized fluid and circulate the pressurized fluid through one or more components of power system 10. For example, first cooling circuit 13 may include, among other things, a cooling medium (not shown), one or more fluid transport lines 20, a heat exchanger 21 for extracting heat from the cooling medium, and a valve 22 for regulating the flow of cooling medium through power system 10.

The cooling medium of integrated cooling system 12 may be adapted to absorb heat from one or more components along a flow path of integrated cooling system 12. For example, the cooling medium may include, air, water, ethylene glycol-based coolant, petroleum-based lubricating oil, synthetic oil, silica-based gel, air, gaseous coolant, or any other appropriate material for absorbing and/or dissipating heat.

Fluid transport lines 20 may be configured to transport the cooling medium throughout integrated cooling system 12. For example, fluid transport lines 20 may include tubular devices configured to provide a fluid flow path for the cooling medium. Fluid transport lines 20 may be constructed from various materials such as, for example, rubber, polymer, PVC, alloy metal, steel, copper, or any appropriate type of fluid transport material. Furthermore, it is also contemplated that fluid transport lines may be rigid, flexible, semi-rigid, semi-flexible, or any appropriate combination or degree of stiffness.

Heat exchanger 21 may be disposed within the flow path of first cooling circuit 13 and may include one or more devices configured to transfer heat from one fluid to another. For example, heat exchanger 21 may include an air cooled radiator for an automobile integrated cooling system wherein high temperature coolant is passed through a variety of coils which are cooled by the circulation of air flowing between and around the coils. It is also contemplated that heat exchanger 21 may include another type of heat exchanger such as, for example, a shell and tube heat exchanger, a plate-type heat exchanger, an evaporative type heat exchanger, or any other appropriate heat exchange device.

Valve 22 may be operated to modify the flow rate and/or flow path of fluid throughout integrated cooling system 12. For example, if one or more components in the flow path of a main artery of cooling circuit 13 requires increased flow rate of cooling medium, valve 22 may be closed to limit the flow of cooling medium to a non-critical artery (e.g., an artery that provides coolant to the air conditioner) of first cooling circuit 13. It is contemplated that valve 22 may be manually operated, automatically operated, or electrically actuated.

Housing 14 may contain one or more components of integrated cooling system 12 and may be configured to isolate the components of integrated cooling system 12 from the surrounding environment. For example, housing 14 may contain pumping device 15, motor 16, controller 17, and at least a portion of second cooling circuit 18. Housing 14 may also provide one or more flow paths for the cooling medium. Housing 14 may be constructed from various materials such as, for example, a polymer, aluminum, an alloy metal, steel, PVC, rubber, or any other suitable material.

Pumping device 15 may be disposed within housing 14 and may include one or more devices operable to pressurize the cooling medium. For example, in one embodiment, pumping device 15 may include an impeller coupled to a shaft that, when rotated, is configured to circulate a cooling medium throughout integrated cooling system 12. It is further contemplated that pumping device 15 may include other devices for pressurizing a cooling medium, such as a piston housed in a pumping chamber, a gear displacement system, a rotating blade, a pressurization jet, or any other such device.

Motor 16 may be disposed within housing 14 and configured to provide mechanical force for moving pumping device 15. For example, motor 16 may include a brushless DC motor that may be operatively coupled to an impeller to provide rotational force for pressurizing the cooling medium. It is also contemplated that motor 16 may include any appropriate type of motor for providing mechanical energy output such as, an AC induction motor, a universal motor, a linear motor, a pulse drive, or any other type of motor capable of moving pumping device 15.

Motor 16 may include a fluid flow passage to provide a flow of cooling medium through one or more components of motor 16. For example, a rotor associated with motor 16 may be configured with a hollow passage through the longitudinal axis that provides a fluid flow path to allow cooling of the components of the motor. Alternatively and/or additionally, a stator core associated with motor 16 may be configured with a fluid flow path to provide cooling. It is also contemplated that additional flow paths may be provided through one or more portions of motor 16 such as, for example, the motor housing, the field conductors, the rotor magnet, the motor bearing housing and/or any other portion of motor 16 that may be cooled.

Controller 17 may be disposed within housing 14 and may include one or more components configured to regulate the operation of motor 16. For example, controller 17 may include voltage controlling elements that regulate the amount of voltage supplied to motor 16, thereby regulating the rotational field that controls motor speed. Controller 17 may also include various components (not shown) for running software applications. For example, controller 17 may include a central processing unit (CPU) (not shown), a computer-readable memory (not shown), a random access memory (RAM) (not shown), input/output (I/O) elements (not shown), etc. Controller 17 may be a stand-alone unit, or alternatively, may be integrated within a portion of motor 16.

Controller 17 may be coupled to one or more data monitoring devices (not shown) and configured to monitor one or more operational aspects of motor 16 and/or integrated cooling system 12. For example, controller 17 may be coupled to, for example, a temperature sensor, a vibration sensor, a pressure sensor, a voltmeter, an ammeter, or any other appropriate device for monitoring data. Data monitoring devices may be configured to monitor one or more operational aspects of motor 16 and/or integrated cooling system 12 such as, for example, field conductor temperature, cooling medium temperature, fluid pressure, field winding current, applied voltage to one or more field windings, vibration in motor bearings, fluid capacity, fluid conductivity, or any other aspect associated with the operation of integrated cooling system 12.

Controller 17 may be configured to operate one or more devices associated with the flow of fluid through integrated cooling system 12 based on monitored data. For example, controller 17 may operate a feedback valve 19 and/or a valve 22 to regulate the flow of fluid based on a monitored temperature, pressure, and/or flow rate of the fluid of integrated cooling system 12. If, for example, a temperature associated with power source 11 exceeds a predetermined limit, one or more valves 22 may be closed, restricting the flow of fluid to non-essential devices so that integrated cooling system 12 may provide the appropriate cooling capacity for essential devices (e.g., power source 11). Similarly, should a temperature associated with at least part of motor 16 exceed a predetermined limit, feedback valve 19 may be opened, permitting the flow of fluid through motor 16 so that integrated cooling system 12 may provide the appropriate cooling capacity to ensure appropriate operation of motor 16.

One or more data monitoring devices may be communicatively coupled to controller 17 and may be configured to monitor one or more operational aspects of integrated cooling system 12. Furthermore, data monitoring devices may be configured to monitor one or more aspects associated with the operation of integrated cooling system 12 such as, for example, rotor speed of the motor, temperature of the motor windings, pressure of the cooling medium, current flowing in the motor windings, vibration of the motor, or any such aspect. As FIG. 1 illustrates and in one disclosed embodiment, data monitoring devices may be included within controller 17. It is further contemplated that alternate embodiments may include one or more data monitoring devices separate from controller 17 (not shown) as standalone monitoring elements.

Second cooling circuit 18 may be at least partially disposed within housing 14 and may contain one or more components to regulate and direct the flow of fluid within housing 14. For example, second cooling circuit 18 may include feedback valve 19 and one or more fluid transport lines 20 to control the flow of cooling medium through and/or near one or more components disposed within housing 14.

Second cooling circuit 18 may regulate the flow of high pressure fluid from first cooling circuit 13, direct the fluid through one or more components disposed within housing 14, and deposit the fluid back into first cooling circuit 13. For example, as illustrated in FIG. 1, second cooling circuit 18 may receive high pressure fluid from first cooling circuit 13 downstream from pumping device 15 (i.e., the high pressure side substantially near the output flow path of pumping device 15), direct fluid flow throughout housing 14 and substantially within and/or near one or more components disposed within housing 14, and output the fluid upstream from pumping device 15 (i.e., the low pressure side substantially near the input flow path of the pumping device). It is also contemplated that the output flow path of second cooling circuit 18 may be upstream of heat exchanger 21 to provide additional cooling treatment to the fluid output from second cooling circuit 18.

Feedback valve 19 may be communicatively coupled to controller 17 and configured to regulate the flow of fluid through second cooling circuit 18. For example, feedback valve 19 may be configured to receive command signals from controller 17 and open or close based on the received signals. Alternatively, feedback valve 19 may be associated with a data monitoring device of controller 17 and may be configured to automatically respond to data provided by such a data monitoring device. For example, feedback valve 19 may be configured to receive data from a temperature sensor associated with motor 16. If the data received from the temperature sensor exceeds a predetermined limit, feedback valve 19 may automatically open or close to permit additional fluid flow through housing 14 to accommodate the needs of motor 16.

A heat conducting element 23 may be included in second cooling circuit 18 and may include any device operable to extract heat from one or more components of integrated cooling system 12 and dissipate the extracted heat to a cooling medium. For example, heat conducting element 23 may include a copper bar in contact with controller 17 to extract heat generated by controller 17 and dissipate the extracted heat to the surrounding cooling medium. Although heat conducting element 23 is illustrated as a copper bar, it is contemplated that heat conducting element 23 may include any appropriate material for effective dissipation of heat from controller 17 such as, for example, a metallic material, a metal alloy, aluminum, or any other such material. Furthermore, heat conducting element 23 may be arranged in a variety of configurations depending on the space requirements and desired level of thermal transfer. It is also contemplated that heat conducting element 23 may be configured in a variety of shapes and thicknesses in order to provide optimal heat dissipation qualities while conforming to the space requirements within housing 14.

Communication lines 24 may include one or more components configured to communicatively couple controller 17 to pumping device 15 and motor 16. Communication lines 24 may include electrical wires, twisted pair cables, optical fiber cables, wireless links, infrared links, Bluetooth connections, or any other media know in the art for transmission of data information. Data information may be transmitted using an analog format, a digital format, or any combination thereof to communicate information over communication lines 24.

INDUSTRIAL APPLICABILITY

The disclosed integrated cooling system may be applicable to any system where an efficient, reliable, and compact motor driven pump may be advantageous. Specifically, the disclosed integrated cooling system may provide an integrated motor driven pumping device that includes a self-cooling circuit for extending the capacity of the motor-driven pumping device. An illustrative method of operation of integrated cooling system 12 will now be described.

Figure 2:
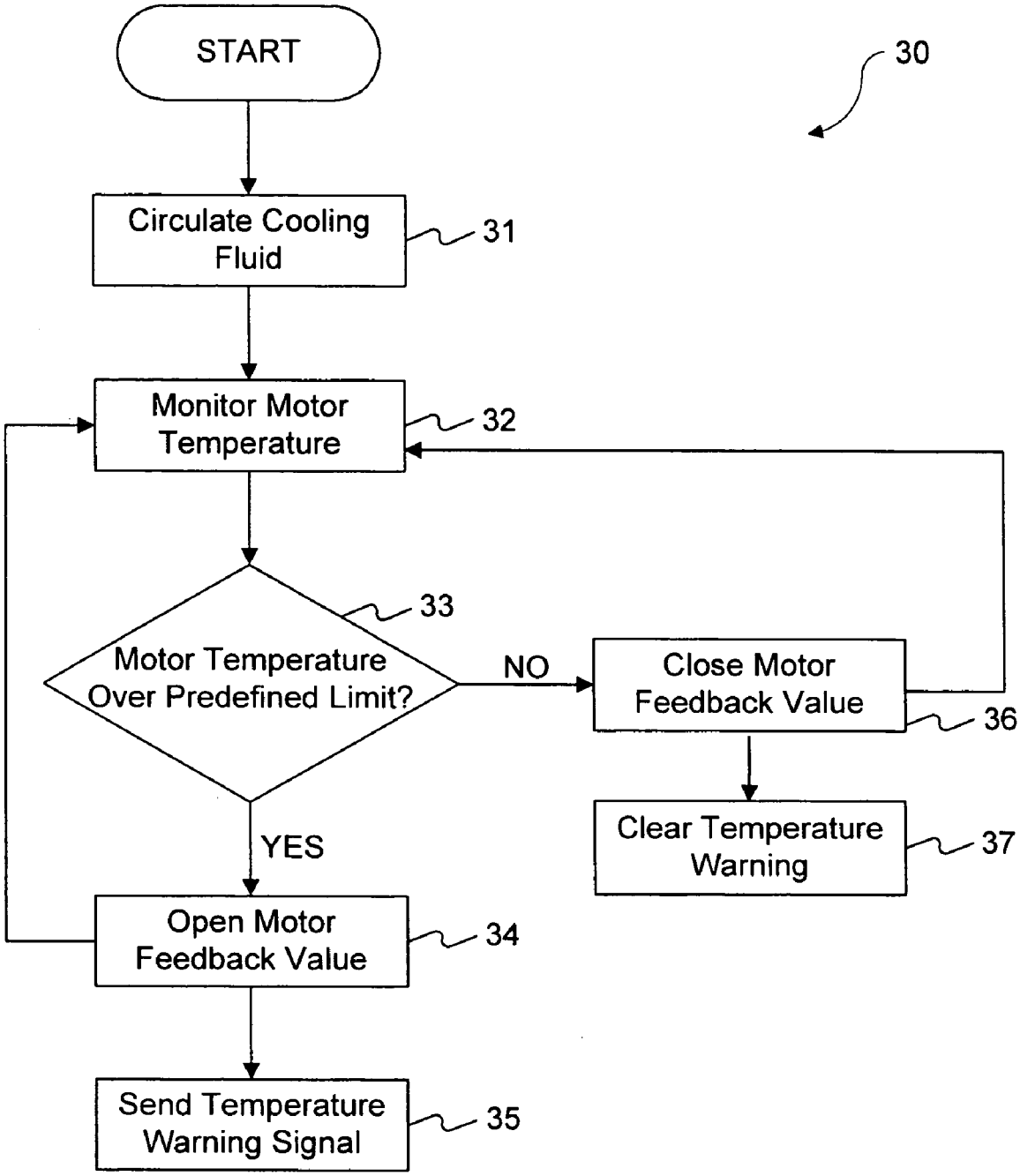
FIG. 2 illustrates a flowchart depicting an exemplary disclosed method for operating the cooling system of FIG. 1.

As illustrated in flowchart 30 of FIG. 2, the operation of integrated cooling system 12 may be initiated when power is supplied to motor 16, prompting circulation of fluid through first cooling circuit 13 (Step 31). The circulation of fluid may be initiated at a predetermined fluid pressure or flow rate based on an initial temperature associated with one or more components of power system 10 such as, for example, power source 11 or a component of power source 11. Fluid flow may be modified after the initial start-up, based on one or more operational aspects monitored by controller 17 and/or the data monitoring devices associated therewith.

Upon initial start-up of integrated cooling system 12, controller 17 may monitor a temperature associated with motor 16 to ensure that motor 16 is operating within a desired temperature threshold level (Step 32). For example, a temperature sensing element of controller 17 may monitor a temperature corresponding to one or more components of motor 16 such as, for example, a heat conducting element 23, controller 17, a stator conductor (not shown), a rotor (not shown), a rotor bearing (not shown), or any other such component that may indicate an operating temperature of motor 16. The monitored parameters may be sent to controller 17 for further analysis.

After appropriate temperature data has been gathered, a determination can be made as to whether the monitored temperature is over a predetermined limit or outside a predetermined range (Step 33). For example, controller 17 may calculate a motor temperature from the one or more monitored parameters to determine if the motor is operating outside a predetermined temperature range. A CPU (not shown) associated with controller 17 may receive a plurality of data parameters corresponding to a temperature associated with motor 16. The CPU of controller 17 may be configured to calculate the temperature of the motor based on one or more data parameters received.

If controller 17 determines that motor 16 is operating outside a predetermined temperature range, feedback valve 19 may be opened to provide additional flow of fluid from first cooling circuit 13 to second cooling circuit 18 and through motor 16 (Step 34). For example, controller 17 may determine that the temperature limit of motor 16 has been exceeded. Controller 17 may provide a command signal to feedback valve 19, requesting that feedback valve 19 be opened to permit fluid flow through second cooling circuit 18, which may direct fluid flow through motor 16. Alternatively, in the absence of second cooling circuit 18, fluid flow may be increased to provide additional fluid to pass through housing 14, thereby providing additional heat extraction from motor 16.

If a temperature associated with motor 16 exceeds a predetermined temperature limit, a temperature warning signal may be sent (Step 35). For example, if controller 17 opens feedback valve 19 in response to an overvalue determination of motor temperature, a warning signal may be sent to a user console, an external diagnostic interface, an electronic control unit of power system 10, or any other device operable to receive warning signals. Warning signals may include any form of signalization such as, for example, an electrical signal, an audible signal, a visible signal, or any other signal for indication of a temperature overvalue condition.

Alternatively, if controller 17 determines that motor 16 is operating within the predetermined temperature range, controller 17 may close feedback valve 19 to maximize the flow of fluid through first cooling circuit 13 (Step 36). For example, in order to maximize the efficiency of integrated cooling system 12, feedback valve 19 may be closed to ensure that no cooling capability is expended unnecessarily for cooling motor 16 under normal temperature operation. If controller 17 closes feedback valve 19, which may indicate that the motor is operating within the predetermined temperature range, any temperature limit warnings may be appropriately cleared to indicate that motor 16 may have returned to the predetermined temperature range (Step 37).

In addition, in alternative embodiments it is contemplated that integrated cooling system 12 may be configured to continuously or periodically monitor motor temperature. Once a determination of the motor temperature has been made and feedback valve 19 correspondingly operated (Steps 34, 36), the system may cycle back to Step 32 to monitor the temperature.

Feedback valve 19 may be partially opened or partially closed based on the desired amount of temperature control of integrated cooling system 12. For example, should the temperature exceed the predetermined range by a substantially small amount (e.g. 1-2 degrees), feedback valve 19 may be partially opened to provide an intermediate level of fluid flow to regulate the temperature appropriately. If additional heat dissipation is subsequently required, feedback valve 19 may be opened more, providing additional fluid flow to motor 16.

Furthermore, a number of different operational aspects of integrated cooling system 12 may be monitored to control the flow of fluid through power system 10. For example, feedback valve 19 may be operated to provide pressure relief for integrated cooling system 12, should the pressure exceed a predetermined range.

The presently disclosed integrated cooling system may offer several advantages. For example, because controller 17 may be configured to monitor one or more operational aspects of integrated cooling system 12 and regulate the operation of motor 16 based on the monitored operational aspects, energy efficiency associated with power source 11 may be increased as the power supplied to motor 16 may be regulated based on cooling requirements of the system. Furthermore, monitoring of motor 16 can help prevent overheating of motor 16 and, therefore, may reduce costly repairs and power system down-time associated with premature motor failure.

Furthermore, the presently disclosed integrated cooling system may enhance control capabilities of integrated cooling system 12. For example, the inclusion of second cooling circuit 18, which includes feedback valve 19 operated by controller 17, may increase temperature control of cooling circuit 12. This may provide a variable flow rate to motor 16 based on the necessities of motor 16, as opposed to cooling the motor based on the needs of another component located downstream of motor 16. As a result, the additional cooling may increase the available torque output of motor 16, as additional fluid flow may extract any additional heat generated by an increase in motor speed.

The presently disclosed integrated cooling system 12 may also increase temperature regulation capabilities of motor 16 and controller 17. For example, because a separate motor chamber is not required, the cooling medium may circulate more directly through housing 14, in close contact with motor 16 and controller 17. Further, the inclusion of heat conducting element 23 may provide additional heat dissipation for controller 17 by increasing the surface area for heat transfer.

It will be apparent to those skilled in the art that various modifications and variations can be made to the disclosed cooling system without departing from the scope of the invention. Other embodiments of the present disclosure will be apparent to those skilled in the art from consideration of the specification and practice of the present disclosure. It is intended that the specification and examples be considered as exemplary only, with a true scope of the present disclosure being indicated by the following claims and their equivalents.

What is claimed is:

1. An integrated cooling system, comprising:

a housing;

a pumping device disposed within the housing and configured to pressurize a fluid;

a motor disposed within the housing and operatively coupled to the pumping device, wherein the motor comprises one or more conduits disposed substantially among field windings of the motor;

a first cooling circuit configured to:

receive the pressurized fluid; and circulate the pressurized fluid through at least one component external to the housing; and a second cooling circuit, in fluid communication with the first cooling circuit, and configured to direct at least a portion of the pressurized fluid through the conduit, wherein the second cooling circuit includes a valve that is disposed substantially within the housing and configured to control a flow rate of the pressurized fluid through the motor.

2. An integrated cooling system, comprising:

a housing;

a pumping device disposed within the housing and configured to pressurize a fluid;

a motor disposed within the housing and operatively coupled to the pumping device, wherein the motor comprises a hollow passage through a portion of one or more of a stator and a rotor of the motor, for providing a fluid flow passage therethrough;

a first cooling circuit configured to:

receive the pressurized fluid; and circulate the pressurized fluid through at least one component external to the housing; and a second cooling circuit, in fluid communication with the first cooling circuit, and configured to direct at least a portion of the pressurized fluid through the hollow passage, wherein the second cooling circuit includes a valve that is disposed substantially within the housing and configured to control a flow rate of the pressurized fluid through the motor.

3. The cooling system of claim 2, wherein the fluid includes a cooling medium adapted to extract heat.

4. The cooling system of claim 2, wherein the second cooling circuit is further configured to:

draw the pressurized fluid from downstream of the pumping device; and deposit the pressurized fluid upstream of the pumping device.

5. The cooling system of claim 2, further including a controller disposed within the housing and communicatively coupled to the motor, the controller configured to monitor at least one operational aspect associated with the first or second cooling circuit.

6. The cooling system of claim 5, wherein the controller is further configured to regulate operation of the motor based on the at least one operational aspect.

7. The cooling system of claim 5, wherein the controller is further configured to control a flow rate of the pressurized fluid based on the at least one monitored operational aspect.

8. The cooling system of claim 5, further including a heat conducting element in fluid communication with the second cooling circuit, the heat conducting element configured to transfer heat from at least one of the motor and the controller.

9. The cooling system of claim 8, wherein at least a portion of the controller is attached to the heat conducting element.

10. The cooling system of claim 5, wherein the at least one operational aspect includes a temperature associated with at least part of the motor.

11. The cooling system of claim 5, wherein the at least one operational aspect includes a flow associated with the first or second cooling circuit.

12. The cooling system of claim 5, wherein the at least one operational aspect includes a pressure associated with the first or second cooling circuit.

13. The cooling system of claim 5, wherein the at least one operation aspect includes a bearing noise associated with at least part of the motor.

14. The cooling system of claim 13, wherein the controller further includes a temperature sensitive element operatively coupled to the motor and configured to monitor the temperature.

15. A method for operating a cooling system having a housing, a pumping device disposed within the housing and configured to pressurize a fluid, a motor disposed within the housing and operatively coupled to the pumping device, wherein the motor comprises a hollow passage through a portion of one or more of a stator and a rotor of the motor, for providing a fluid flow passage therethrough, the method comprising:

operating the motor to pump a fluid through a first cooling circuit;

monitoring at least one operational aspect of the motor; and directing at least a portion of the circulated fluid through a second cooling circuit in fluid communication with the first cooling circuit, the second fluid circuit configured to direct at least a portion of the pressurized fluid through the hollow passage, wherein the second cooling circuit includes a valve that is disposed substantially within the housing and configured to control a flow rate of the pressurized fluid through the motor based on the at least one operational aspect of the motor.

16. The method of claim 15, wherein the monitoring includes sensing a temperature associated with at least part of the motor and comparing the sensed temperature to a threshold limit.

17. The method of claim 15, wherein directing includes operating the valve associated with the second cooling circuit to change a flow rate of the fluid.

18. The method of claim 15, wherein the at least one operational aspect includes a temperature associated with at least part of the motor.

19. A power system, comprising:

a power source configured to generate a power output;

a housing;

a pump disposed within the housing and configured to:

pressurize a fluid; and direct the pressurized fluid within the housing through the power source via a first cooling circuit to cool the power source;

a heat exchanger, in fluid communication with the first cooling circuit, configured to remove heat from the pressurized fluid;

a motor disposed within the housing and operatively coupled to the pump, wherein the motor comprises a hollow passage through a portion of one or more of a stator and a rotor of the motor, for providing a fluid flow passage therethrough;

a controller disposed within the housing, in communication with the motor, and configured to:

monitor at least one operational aspect of a cooling system associated with the power system; and regulate operation of the motor based on the at least one operational aspect; and a second cooling circuit, in fluid communication with the first cooling circuit, and configured to direct at least a portion of the pressurized fluid from the first cooling circuit through the hollow passage, wherein the second cooling circuit includes a valve that is disposed substantially within the housing and configured to control a flow rate of the pressurized fluid through the motor.

20. The power system of claim 19, wherein the second cooling circuit is further configured to:

draw the pressurized fluid from downstream of the pumping device; and deposit the pressurized fluid upstream of the pump.

21. The power system of claim 19, wherein the controller is further configured to control the flow rate of the pressurized fluid based on the at least one monitored operational aspect.

22. The power system of claim 19, further including a heat conducting element in fluid communication with the second cooling circuit, the heat conducting element configured to transfer heat from at least one of the motor and the controller.

23. The power system of claim 19, wherein the at least one operational aspect includes a temperature associated with at least part of the motor.

24. The power system of claim 19, wherein the controller further includes a temperature sensitive element operatively coupled to the motor and configured to monitor a temperature associated with at least part of the motor.

25. An integrated cooling system, comprising:

a housing;

a pumping device disposed within the housing and configured to pressurize a fluid;

a motor disposed within the housing and operatively coupled to the pumping device, wherein the motor comprises a hollow passage through a portion of one or more of a stator and a rotor of the motor, for providing a fluid flow passage therethrough; and a valve disposed substantially within the housing and configured to control a flow rate of the pressurized fluid through the hollow passage.

26. The cooling system of claim 25, further including a controller disposed within the housing and communicatively coupled to the motor, the controller configured to monitor at least one operational aspect associated with the first or second cooling circuit.

27. The cooling system of claim 26, wherein the controller is further configured to regulate operation of one or more of the motor or the valve based on the at least one operational aspect.

28. The cooling system of claim 26, wherein the controller is further configured to control a flow rate of the pressurized fluid based on the at least one operational aspect.

29. The cooling system of claim 26, further including a heat conducting element in fluid communication with the second cooling circuit, the heat conducting element configured to transfer heat from at least one of the motor and the controller.

30. The cooling system of claim 29, wherein at least a portion of the controller is attached to the heat conducting element.

31. The cooling system of claim 26, wherein the at least one operational aspect includes a temperature associated with at least part of the motor.

32. The cooling system of claim 26, wherein the at least one operational aspect includes a flow associated with the first or second cooling circuit.

33. The cooling system of claim 26, wherein the at least one operational aspect includes a pressure associated with the first or second cooling circuit.

34. The cooling system of claim 26, wherein the at least one operation aspect includes a bearing noise associated with at least part of the motor.

35. The cooling system of claim 34, wherein the controller further includes a temperature sensitive element operatively coupled to the motor and configured to monitor the temperature.

* * * * *